US012565397B2

(12) United States Patent
Saito et al.

(10) Patent No.: US 12,565,397 B2
(45) Date of Patent: Mar. 3, 2026

(54) WINDING DEVICE AND WINDING METHOD

(71) Applicant: SUMITOMO ELECTRIC INDUSTRIES, LTD., Osaka (JP)

(72) Inventors: Takahiro Saito, Osaka (JP); Iwao Okazaki, Osaka (JP); Ryutarou Miyazaki, Utsunomiya (JP); Yoshihiro Morimoto, Utsunomiya (JP); Masayuki Kato, Utsunomiya (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 351 days.

(21) Appl. No.: 17/422,910

(22) PCT Filed: Jan. 15, 2020

(86) PCT No.: PCT/JP2020/001071
§ 371 (c)(1),
(2) Date: Jul. 14, 2021

(87) PCT Pub. No.: WO2020/149303
PCT Pub. Date: Jul. 23, 2020

(65) Prior Publication Data

US 2022/0127104 A1 Apr. 28, 2022

(30) Foreign Application Priority Data

Jan. 15, 2019 (JP) ..... 2019-004634

(51) Int. Cl.
*B65H 54/02* (2006.01)
*B65H 57/14* (2006.01)

(52) U.S. Cl.
CPC ..... *B65H 54/02* (2013.01); *B65H 57/14* (2013.01); *B65H 2511/14* (2013.01);
(Continued)

(58) Field of Classification Search
CPC .. B65H 54/02; B65H 2511/14; B65H 63/082; B65H 2515/10
See application file for complete search history.

(56) References Cited

U.S. PATENT DOCUMENTS 3,945,580 A * 3/1976 Veyrassat ..... B65H 54/28 242/474.5
5,172,734 A * 12/1992 Matsui ..... D03D 47/34 139/452

(Continued)

FOREIGN PATENT DOCUMENTS

CN 102025114 A 4/2011
JP S48-031313 B1 9/1973

(Continued)

OTHER PUBLICATIONS

JP 2005-200114, Okazaki et al, Jul. 2005, Winding Method and Device for Wire (Year: 2005).*

*Primary Examiner* — William A. Rivera
(74) *Attorney, Agent, or Firm* — Faegre Drinker Biddle & Reath LLP

(57) ABSTRACT

This winding device includes: a bobbin for winding an optical fiber, the bobbin being a striated body; a cover that covers the outer periphery of the bobbin, the cover having provided thereto a slit that is parallel to the axial direction of the bobbin, and the optical fiber being inserted through the slit; and a roller for directly guiding the optical fiber to the bobbin. In accordance with the bobbin winding barrel diameter of the optical fiber on the bobbin, the bobbin and the roller are caused to move relatively, or the position of the slit in the cover is caused to move in the circumferential direction.

5 Claims, 6 Drawing Sheets

(52) U.S. Cl.
CPC ..... *B65H 2515/10* (2013.01); *B65H 2701/32* (2013.01); *B65H 2701/36* (2013.01)

(56) References Cited

U.S. PATENT DOCUMENTS

| | | | | |
|---|---|---|---|---|
| 5,399,815 | A * | 3/1995 | Ballarati | B65H 63/084 73/160 |
| 2004/0052457 | A1* | 3/2004 | Lefebvre | B65H 57/20 385/37 |
| 2006/0011766 | A1* | 1/2006 | Koutonen | G05B 17/02 242/534 |
| 2006/0138271 | A1* | 6/2006 | Yamazaki | B65H 67/052 242/475.7 |
| 2009/0101747 | A1* | 4/2009 | Doeres | B65H 19/10 242/534.2 |

FOREIGN PATENT DOCUMENTS

| | | | |
|---|---|---|---|
| JP | S48-031314 | B1 | 9/1973 |
| JP | S50-135479 | A | 10/1975 |
| JP | S53-024960 | A | 3/1978 |
| JP | S55-080654 | A | 6/1980 |
| JP | S58-071051 | U | 5/1983 |
| JP | H06-051134 | A | 2/1994 |
| JP | H08-290869 | A | 11/1996 |
| JP | 08-333050 | * | 12/1996 |
| JP | H11-071060 | A | 3/1999 |
| JP | 2907381 | B2 | 6/1999 |
| JP | 2005-200114 | A | 7/2005 |

* cited by examiner

WINDING DEVICE AND WINDING METHOD

TECHNICAL FIELD

The present disclosure relates to a winding device and a winding method.

This application is based upon and claims the benefit of priority from Japanese Patent Application No. 2019-004634, filed on Jan. 15, 2019, the entire contents of which are incorporated herein by reference.

BACKGROUND ART

Patent Literature 1 disclosures an optical fiber winding device in which a cover is attached to an outer circumference of a bobbin so that a free-state cleaved terminal wire does not bounce back to a wound-up winding body.

CITATION LIST

Patent Literature

Patent Literature 1: JP-A-2005-200114

SUMMARY OF INVENTION

A winding device according to one aspect of the present disclosure includes:

- a bobbin that winds up a striatum (as used herein striatum is a filament body);
- a cover that covers the bobbin and includes a slit parallel to an axial direction of the bobbin such that the striatum is inserted and;
- a roller that guides the striatum directly to the bobbin; and
- a mechanism for moving the roller relative to the bobbin or moving a location of the slit of the cover in a circumferential direction, depending on a bobbin winding body diameter of the striatum of the bobbin.

A winding method according to one aspect of the present disclosure is a winding method for a winding device including a bobbin that winds up a striatum, a cover that covers the bobbin and includes a slit parallel to an axial direction of the bobbin such that the striatum is inserted, and a roller that guides the striatum directly to the bobbin, in which the roller is moved relative to the bobbin or a location of the slit of the cover is moved in a circumferential direction, depending on a bobbin winding body diameter of the striatum of the bobbin.

DESCRIPTION OF EMBODIMENTS

Figure 1A:
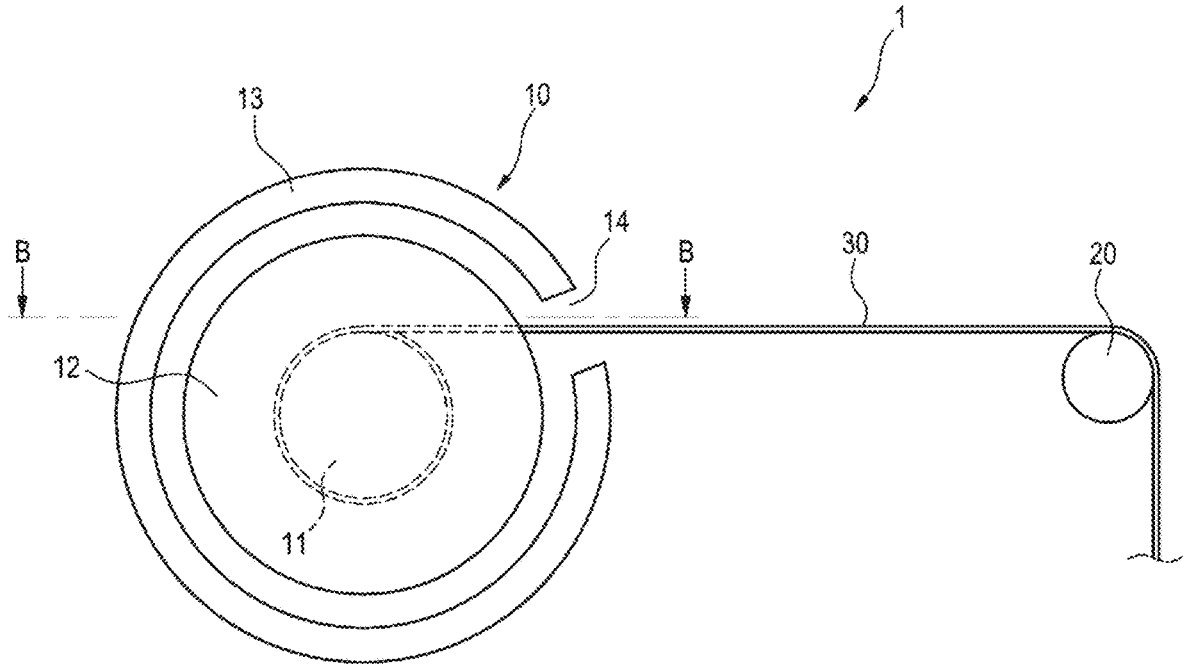
FIG. 1A is a diagram illustrating a configuration example of a winding device according to a first embodiment of the present disclosure.

Technical Problem to be Solved by the Present Disclosure

In a winding device, when winding up a striatum such as an electric wire, an optical fiber, or the like that are continuously fed around a bobbin at a high speed, the winding device cannot immediately stop when the striatum is broken in the middle, such that a cleaved terminal wire becomes a free state and swings around the bobbin with rotation of the bobbin. Therefore, the cleaved terminal wire hits surrounding obstacles and protrusions and bounces back to a wound-up winding body, thereby causing a state called wire hitting that hits a surface of the winding body. This wire hitting has a significant effect on high-speed winding-up and damages the striatum wound up around the bobbin. Particularly, when the striatum is the optical fiber, the optical fiber wound up around the bobbin has low intensity or is broken. When such wire hitting occurs, the optical fiber wound up therearound is required to be discarded, which causes a decrease in yield.

An optical fiber winding device disclosed in Patent Literature 1 can reduce an influence caused by the wire hitting by using a cover provided on an outer circumference of the bobbin. However, as an amount of the optical fiber wound around the bobbin increases, a bobbin winding body diameter becomes large, such that the optical fiber introduced from a roller to the bobbin and the cover provided on the outer circumference of the bobbin may hit each other. In order to prevent this problem, an opening of the cover is required to become large, but when the opening thereof becomes large, the optical fiber bent at the time of being broken easily damages the optical fiber on a bobbin surface. Therefore, it is desirable that a size of the opening thereof is made as small as possible.

The present disclosure has been made in consideration of the above-described circumstances, and an object thereof is to provide a winding device and a winding method in which a cover covering a bobbin can be prevented from contacting a striatum wound up around the bobbin and smooth winding-up of the striatum can be performed.

Advantageous Effects of the Present Disclosure

According to the present disclosure, it is possible to obtain a winding device and a winding method in which a cover covering a bobbin can be prevented from contacting a striatum wound up around the bobbin and smooth winding-up of the striatum can be performed.

Description of Embodiments of the Present Disclosure

First, embodiments of the present disclosure will be listed and described.

(1) A winding device according to one aspect of the present disclosure includes:

a bobbin that winds up a striatum;

a cover that covers the bobbin and includes a slit parallel to an axial direction of the bobbin such that the striatum is inserted;

a roller that guides the striatum directly to the bobbin; and a mechanism for moving the roller relative to the bobbin or moving a location of the slit of the cover in a circumferential direction, depending on a bobbin winding body diameter of the striatum of the bobbin.

Accordingly, it is possible to prevent the cover covering an outer circumference of the bobbin from contacting the striatum wound up around the bobbin, such that smooth winding-up of the striatum can be performed.

(2) A direction of relative movement between the bobbin and the roller may be a direction including a component orthogonal to a direction of the striatum at the start of winding and an axial direction of the roller.

Accordingly, it is possible to simply calculate a required movement distance of the bobbin or the roller.

(3) The bobbin winding body diameter may be calculated from a winding-up length of the striatum, or (4) may be calculated from a weight of the striatum wound around the bobbin.

Accordingly, it is possible to calculate the bobbin winding body diameter of the striatum wound around the bobbin with various methods.

(5) A winding method according to one aspect of the present disclosure is a winding method of a winding device including a bobbin that winds up a striatum, a cover that covers the bobbin and includes a slit parallel to an axial direction of the bobbin such that the striatum is inserted, and a roller that guides the striatum directly to the bobbin, in which the roller is moved relative to the bobbin or a location of the slit of the cover is moved in a circumferential direction, depending on a bobbin winding body diameter of the striatum of the bobbin.

Accordingly, it is possible to prevent the cover covering an outer circumference of the bobbin from contacting the striatum wound up around the bobbin, such that smooth winding-up of the striatum can be performed.

Details of Embodiments of the Present Disclosure

Hereinafter, desirable embodiments according to a winding device and a winding method of the present disclosure will be described with reference to the drawings. An optical fiber is described as an example of a striatum, and in the case of the striatum, the striatum may be not limited to the optical fiber but may be another striatum such as an electric wire or the like. In the following description, a configuration denoted by the same reference sign in different drawings will be regarded as the same configuration, and description thereof may be omitted. As long as a combination of a plurality of embodiments can be performed, the present disclosure includes a combination of any of the embodiments.

The scope of the present invention is not limited to the example of the present disclosure but is indicated by the scope of the claims, and is intended to include all the modifications within the meaning equivalent to the scope of the claims and within the scope thereof.

First Embodiment

Figure 1B:
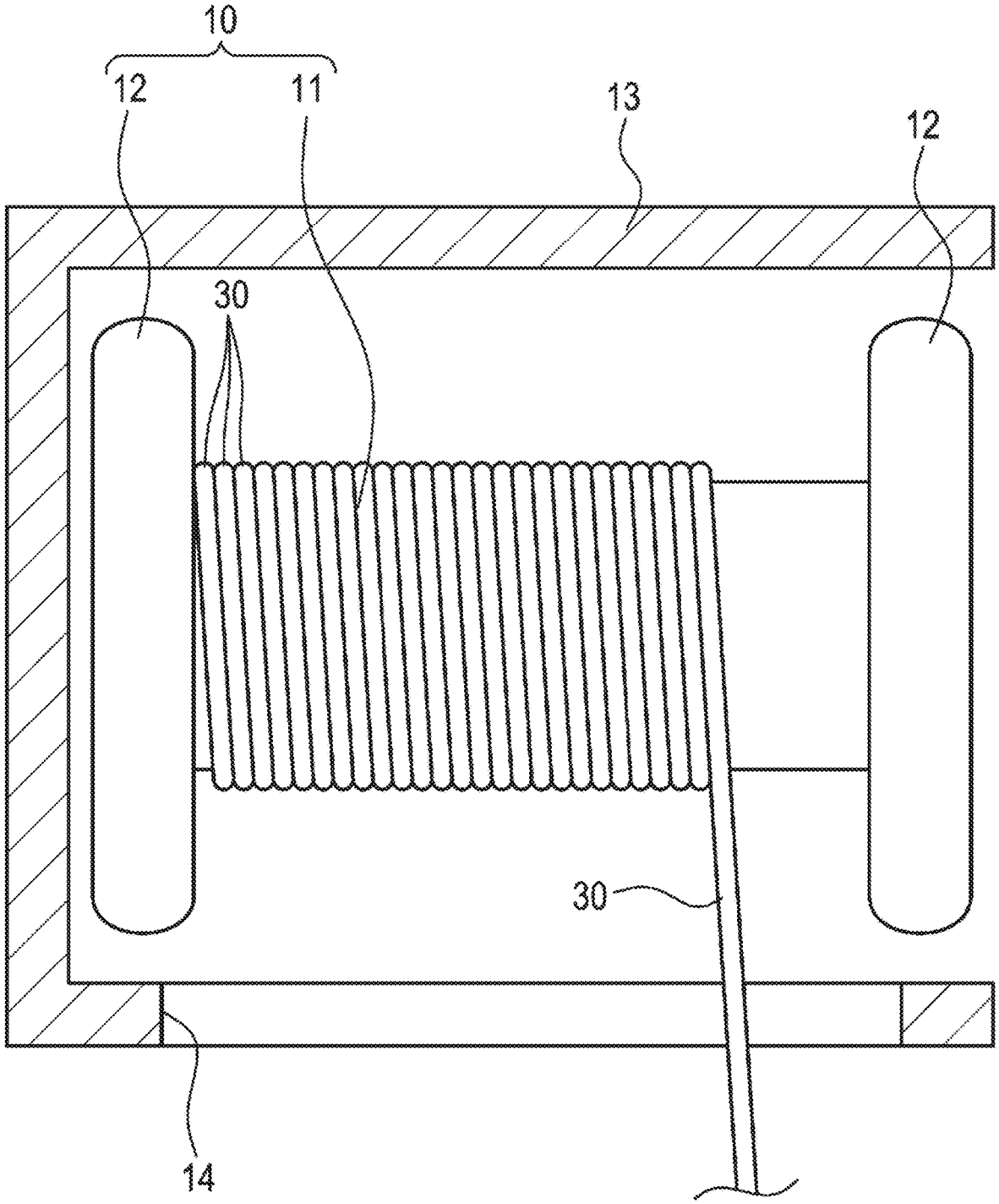
FIG. 1B is a cross-sectional view taken along an arrow line B-B of FIG. 1A.

FIG. 1 is a diagram illustrating a configuration example of a winding device according to an embodiment of the present disclosure. FIG. 1A is a diagram illustrating disposition of a bobbin and a roller viewed from the side, and FIG. 1B is a cross-sectional view taken along an arrow line B-B of FIG. 1A.

A winding device 1 includes a bobbin 10, a cover 13 for preventing wire hitting, and a roller 20.

The bobbin 10 includes a body portion 11 and flange portions 12 provided at opposite ends of the body portion 11. The roller 20 is disposed immediately before an upstream side of the bobbin 10. The cover 13 covers an outer circumference of the bobbin 10 that corresponds to an outer side in a radial direction of the bobbin 10. The cover 13 has an approximately cylindrical shape, and includes a slit 14 through which an optical fiber 30 is inserted and parallel to an axial direction of the bobbin 10. The bobbin 10 is rotated counterclockwise in FIG. 1A by a drive apparatus not illustrated in the drawing, and winds up, for example, the optical fiber 30 after drawing.

The above-described "immediately before the upstream side" does not indicate that locations of the roller 20 and the bobbin 10 are close to each other, but indicates that, as illustrated in FIG. 1A, there are no other members such as a roller or the like in contact with the optical fiber 30 between the roller 20 and the bobbin 10 on the upstream side of the bobbin 10. That is, the roller 20 is a roller that directly guides the optical fiber 30 to the bobbin 10. As long as the roller 20 is the roller that directly guides the optical fiber 30 thereto, for example, the roller 20 may be provided at a location away from the bobbin 10 to a certain extent.

Figure 2A:
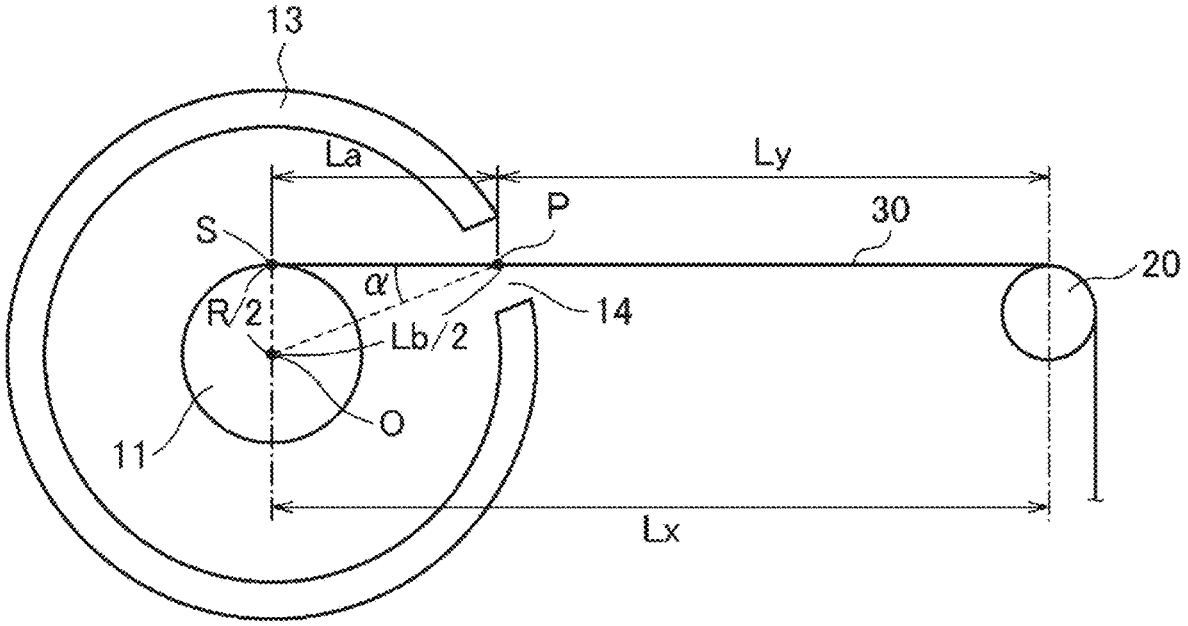
FIG. 2A is a diagram illustrating locations of a bobbin and a roller at the time of the start of winding an optical fiber in the winding device according to the first embodiment of the present disclosure.
Figure 2B:
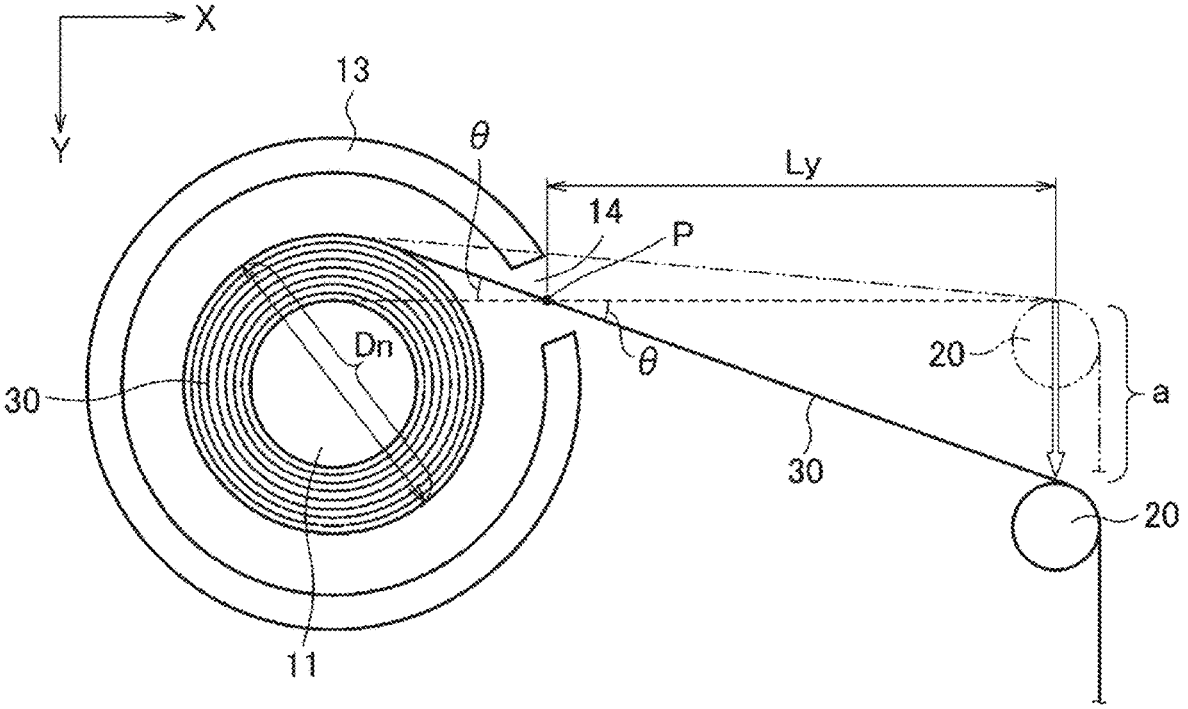
FIG. 2B is a diagram illustrating locations of the bobbin and the roller when a bobbin winding body diameter becomes large by winding up the optical fiber in the winding device of FIG. 2A.

Next, a location relationship between the bobbin and the roller in the embodiment will be described. FIG. 2A is a diagram illustrating a location relationship between the bobbin and the roller in the winding device 1, and illustrates locations of the bobbin and the roller at the time of the start of winding the optical fiber 30. FIG. 2B illustrates locations of the bobbin and the roller when a bobbin winding body diameter becomes large by winding up the optical fiber 30 having a predetermined length in the winding device 1 of FIG. 2A.

As illustrated in FIG. 2A, the optical fiber 30 guided by the roller 20 is wound around the outer circumference of the body portion 11 of the bobbin 10. In the winding device 1, the locations of the bobbin 10 and the roller 20 are adjusted such that the optical fiber 30 passes through a center location of the slit 14 provided in the cover 13 at the start of winding. It is assumed that a path (a movement path) of the optical fiber 30 at the start of winding coincides with an X-axis direction. As a winding-up amount (a length) of the optical fiber 30 wound up around the bobbin 10 increases, a bobbin winding body diameter Dn becomes large. When the bobbin winding body diameter Dn becomes large and the location of the roller 20 does not move from a winding start location, the path of the optical fiber 30 is at a location indicated by an alternate long and two short dashes line in FIG. 2B and contacts the cover 13.

In the embodiment, the location of the roller 20 is caused to move in a Y-axis direction as the bobbin winding body diameter Dn becomes large. As a result, the optical fiber 30 passes through the center location of the slit 14 of the cover 13 even though the winding-up amount thereof increases, and the optical fiber 30 does not contact the cover.

In the embodiment, a movement amount a of the roller 20 is controlled depending on the bobbin winding body diameter Dn of the optical fiber 30. In order to perform this control, it is required to investigate a relationship between a winding-up length (a drawing length) of the optical fiber 30 drawn in advance and the bobbin winding body diameter Dn of the bobbin 10. Next, based upon the relationship therebetween, feedforward control may be performed by determining to what extent a relative location of the roller 20 should be moved with respect to the winding-up length of the optical fiber 30. An actual movement direction of the roller 20 is not required to coincide with the Y-axis direction. In this case, the movement direction of the roller 20 may be any direction including a Y-axis component. A movement amount of the Y-axis direction component at that time may be the movement amount a.

Figure 3:
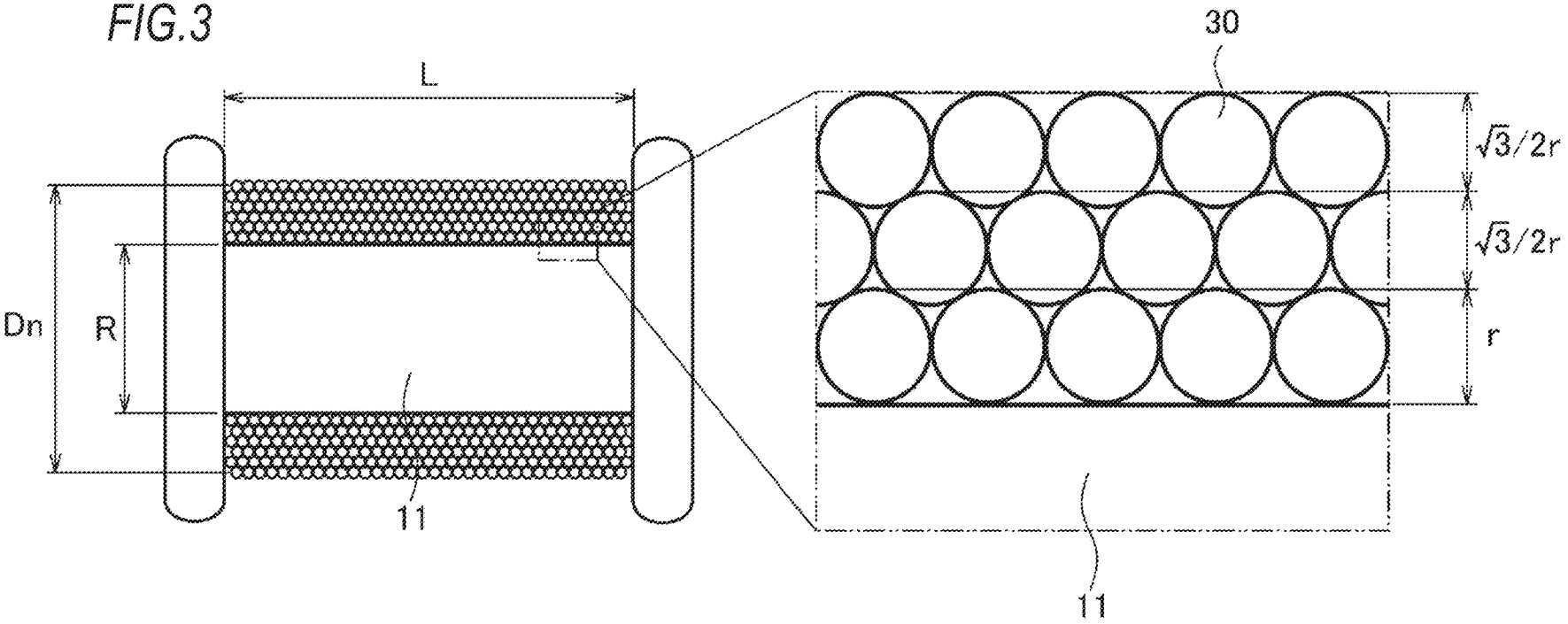
FIG. 3 is a diagram illustrating a relationship between a length of the optical fiber wound up around the bobbin and the bobbin winding body diameter.

The relationship between the bobbin winding body diameter Dn of the bobbin 10 and the winding-up length (the drawing length) of the optical fiber 30 may be obtained by experiment, or may be obtained by numerical calculation. In the embodiment, the bobbin winding body diameter Dn of the bobbin 10 is obtained from the length of the optical fiber 30 by the numerical calculation, and the movement amount of the roller 20 is determined from the bobbin winding body diameter Dn as follows. The winding-up length of the optical fiber 30 may be measured separately. FIG. 3 is a diagram illustrating a relationship between the length of the optical fiber wound up around the bobbin and the bobbin winding body diameter.

A diameter of the body portion 11 of the bobbin 10 is defined as R, an axial length is defined as L, a diameter of the optical fiber 30 is defined as r, and a bobbin winding body diameter of an n-th layer is defined as Dn (n is an integer). It is assumed that the optical fibers 30 are tightly wound around the body portion 11 of the bobbin 10 without any gaps therebetween. Next, a bobbin winding body diameter D1 of a first layer, a bobbin winding body diameter D2 of a second layer, and the bobbin winding body diameter Dn of the n-th layer can be represented by the following Equation 1. The bobbin winding body diameter Dn corresponds to a distance between a center of the optical fiber 30 located on an outmost circumstance wound up around the bobbin 10 and a center of the optical fiber 30 located on an outmost circumstance on an opposite side of a center of the bobbin 10. An example of the optical fiber 30 includes the one formed in such a manner that a glass fiber having a diameter of 125 μm is coated with a primary coating layer and a secondary coating layer formed of an ultraviolet curable resin, respectively, and an outermost circumference of the glass fiber is further coated with a colored layer formed of ultraviolet curable ink to form the diameter r of 250 μm.

[Equation 1]

$$D1=R+r$$

$$D2=R+r+\sqrt{3}r$$

$$Dn=R+r+(n-1)\sqrt{3}r \quad \text{(Equation 1)}$$

The number of turns of the optical fiber 30 per layer is defined as k. A winding-up length A1 of the optical fiber of the first layer, a winding-up length A2 of the optical fiber of the second layer, and a winding-up length An (n is an integer) of the optical fiber of the n-th layer can be represented by the following Equation 2.

[Equation 2]

$$k=\frac{L}{r} \quad \text{(Equation 2)}$$

$$A1=k\pi(R+r)$$

$$A2=A1+k\pi\left(R+r+\sqrt{3}\,r\right)$$

$$An=A(n-1)+k\pi\left\{R+r+(n-1)\sqrt{3}\,r\right\}$$

Figure 4:
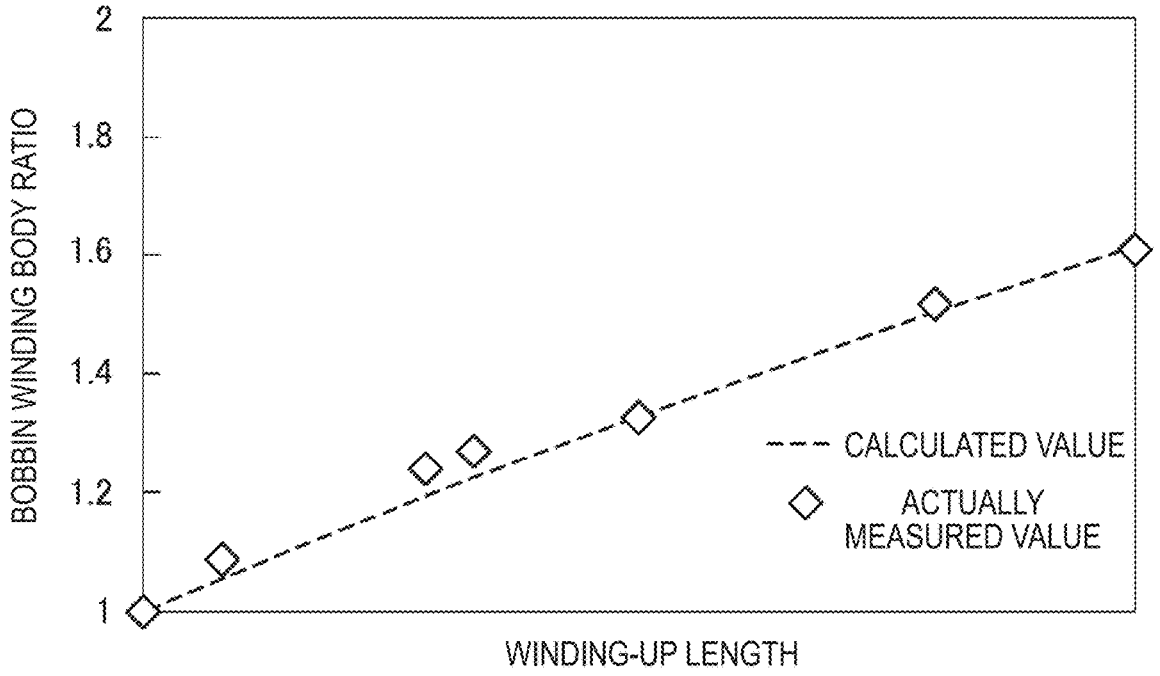
FIG. 4 is a diagram illustrating a relationship between a calculated value and an actually measured value with respect to the relationship between the winding-up length of the optical fiber wound up around the bobbin and the bobbin winding body diameter.

From the winding-up length of the optical fiber 30, the number of layers (the n-th layer) of the bobbin 10 around which the optical fiber 30 is wound is calculated from Equation 2, and the number of layers n is applied to Equation 1, thereby making it possible to obtain the bobbin winding body diameter Dn. FIG. 4 is a diagram illustrating a relationship between a calculated value and an actually measured value with respect to the relationship between the winding-up length (the drawing length) of the optical fiber wound up around the bobbin and the bobbin winding body diameter. A broken line shows the calculated value obtained by Equation 2, and a ◇ mark indicates the actually measured value. In FIG. 4, the bobbin winding body diameter is shown as a ratio (a ratio of the body diameter at the start of winding to the body diameter of the n-th layer), and the calculated value and the actually measured value almost coincide with each other such that the bobbin winding body diameter Dn can be known from the winding-up length of the optical fiber.

Depending on a change in the bobbin winding body diameter Dn, the movement amount a for causing the roller 20 to move in the Y-axis direction is obtained so that the optical fiber 30 does not contact the cover 13. As illustrated in FIG. 2A, when a distance in the X-axis direction between the center of the bobbin 10 and a center of the roller 20 is defined as Lx, a distance from a contact point S of the bobbin 10 of the optical fiber 30 at the time of the start of winding to a middle point P of the slit 14 of the cover 13 is defined as La, and a diameter of the cover 13 is defined as Lb (specifically, a diameter between middle points of a thickness of the cover 13), a distance Ly from the middle point P of the slit 14 of the cover 13 to a contact point of the roller 20 can be represented by the following Equation 3.

[Equation 3]

$$Ly=Lx-La \quad \text{(Equation 3)}$$

$$=Lx-\frac{\left(\sqrt{Lb^2-R^2}\right)}{2}$$

Next, as illustrated in FIG. 2B, the roller 20 is caused to move in the Y-axis direction by the movement amount a when the bobbin winding body diameter Dn becomes large, such that the path of the optical fiber 30 inclines by an angle θ with respect to the X-axis. By using the inclination angle θ at this time, the movement amount a can be obtained by the following Equation 4.

[Equation 4]

$$a = Ly \times \tan\theta = \left(Lx - \frac{\left(\sqrt{Lb^2 - R^2}\right)}{2}\right) \times \tan\theta \quad \text{(Equation 4)}$$

When the distance in the X-axis direction between the center of the bobbin 10 and the center of the roller 20 is defined as Lx, the diameter Lb of the cover 13 and the diameter R of the bobbin are already known, such that the angle θ may be obtained in order to obtain the movement amount a from Equation 4.

Figure 5:
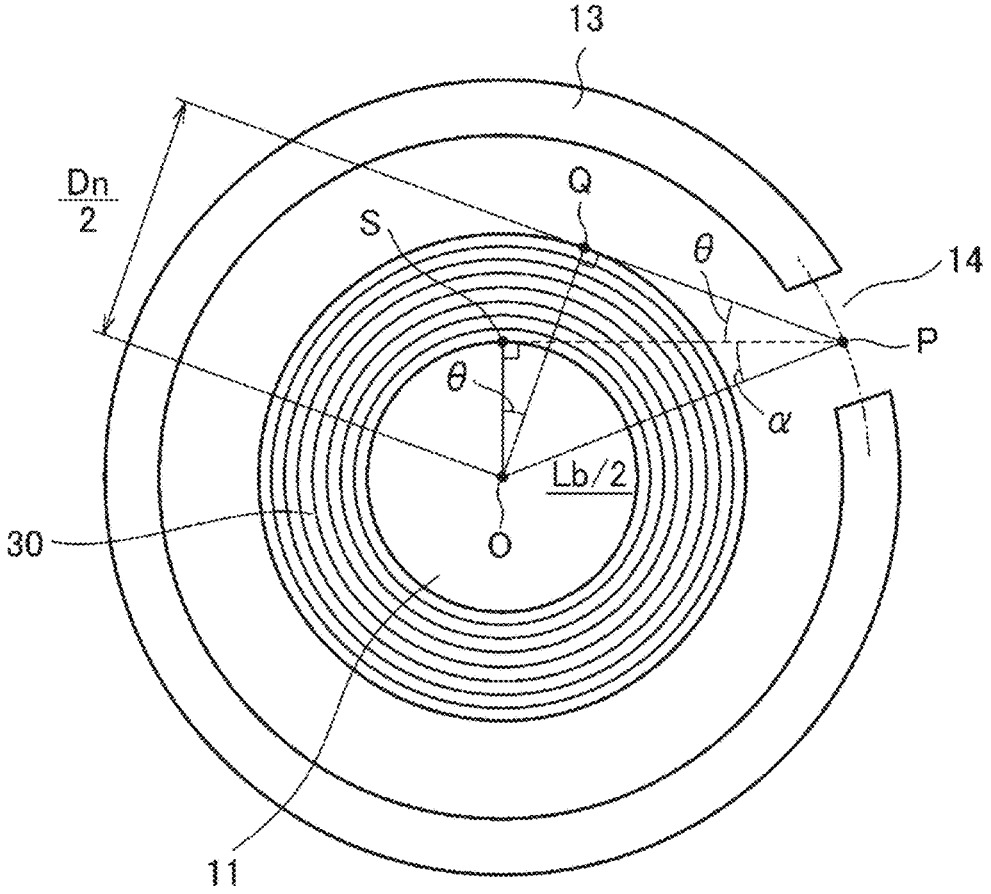
FIG. 5 is a diagram illustrating the bobbin winding body diameter and a winding-up angle of the optical fiber.

FIG. 5 is a diagram illustrating the bobbin winding body diameter and a winding-up angle of the optical fiber. An angle formed by a tangent line from the middle point P of the slit 14 to the body portion 11 of the bobbin 10 and a line connecting the center of the bobbin 10 is defined as α. The bobbin winding body diameter Dn of the n-th layer can be obtained from Equation 1. A distance from the center of the bobbin 10 to the center of the optical fiber 30 wound around the outermost side is defined as Dn/2. The following Equation 5 is established with respect to a triangle OPQ and a triangle OPS illustrated in FIG. 5. Here, O is a center point of the bobbin 10, and Q is a tangential contact point from the middle point P of the slit 14 to the center of the optical fiber 30 wound around the outermost circumference of the bobbin 10.

[Equation 5]

$$\sin(\theta + \alpha) = \frac{Dn}{Lb} \quad \text{(Equation 5)}$$

$$\sin\alpha = \frac{R}{Lb}$$

Accordingly, an angle θ is obtained by the following Equation 6.

[Equation 6]

$$\theta = \sin^{-1}\left(\frac{Dn}{Lb}\right) - \sin^{-1}\left(\frac{R}{Lb}\right) \quad \text{(Equation 6)}$$

In Equation 6, since the diameter r of the optical fiber 30, the diameter R of the body portion 11 of the bobbin 10, and the diameter Lb of the cover 13 are already known, the angle θ can be obtained from the bobbin winding body diameter Dn obtained from Equation 1. The movement amount a of the roller 20 can be obtained by substituting the angle θ obtained in Equation 6 into Equation 4.

Figure 6:
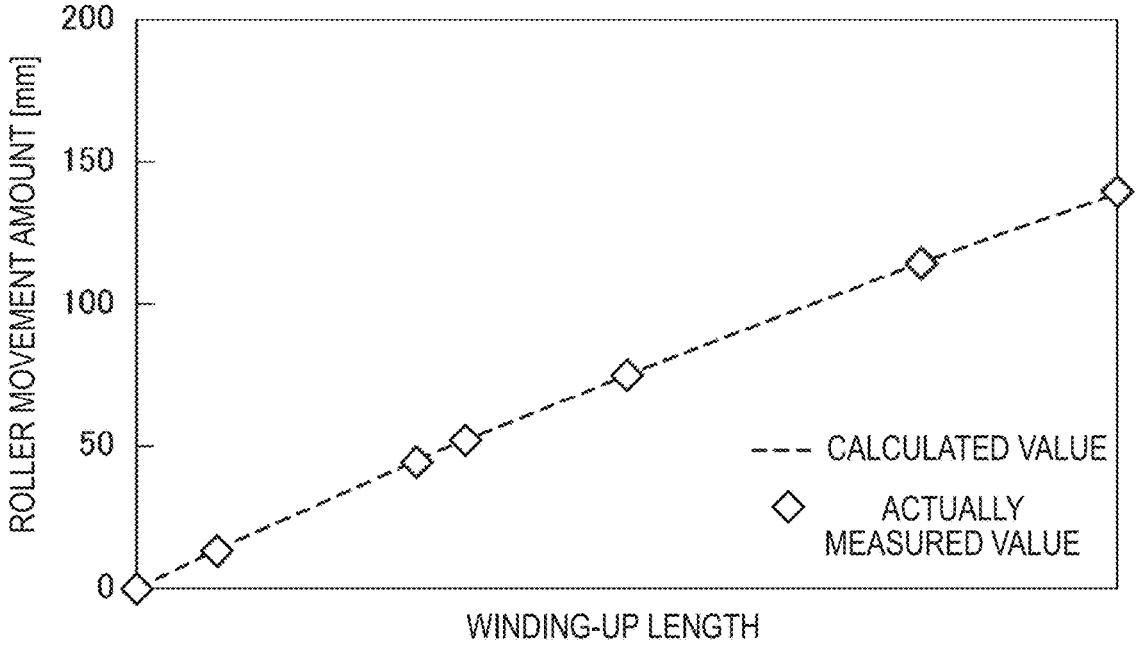
FIG. 6 is a diagram illustrating a relationship between a calculated value of a roller movement amount with respect to the winding-up length of the optical fiber wound up around the bobbin and an actually measured value of the actual roller movement.

FIG. 6 is a diagram illustrating a relationship between a calculated value of the movement amount of the roller with respect to the winding-up length of the optical fiber wound up around the bobbin and an actually measured value of the actual roller movement. In FIG. 6, a broken line is a plot of the movement amount of the roller 20 calculated from Equation 4 based upon the winding-up length of the optical fiber 30 being drawn. A ◇ mark indicates the actually measured value of the movement amount of the roller 20 when the roller 20 is caused to move so as to allow the optical fiber 30 to pass through the center of the slit 14 at some winding-up lengths of the optical fiber 30 during the actual drawing. As illustrated in FIG. 6, the actually measured value and the calculated value almost coincide with each other. As a result of placing an actual location of the roller 20 at a location of a value calculated by the calculated value, it is confirmed that the optical fiber 30 can be wound up without contacting the cover 13 at points of all the actually measured values.

Second Embodiment

The first embodiment describes the method of calculating the bobbin winding body diameter Dn from the winding-up length of the optical fiber 30, and the bobbin winding body diameter Dn changes depending on a weight of the optical fiber 30 wound up around the bobbin 10. Therefore, instead of calculating the bobbin winding body diameter Dn from the winding-up length of the optical fiber 30, the bobbin winding body diameter Dn may be calculated from the weight of the optical fiber 30 wound around the bobbin 10. In order to obtain the weight of the optical fiber 30 wound around the bobbin 10, the weight of the bobbin 10 in a state where the optical fiber 30 is wound therearound may be measured, and the weight of the bobbin 10 itself measured in advance may be subtracted therefrom. The bobbin winding body diameter Dn may be calculated from the weight of the optical fiber 30 wound around the bobbin 10 obtained as described above.

Third Embodiment

In the first and second embodiments, the bobbin winding body diameter Dn is obtained from the winding-up length of the optical fiber 30 and the weight of the optical fiber 30 wound around the bobbin 10, and the bobbin winding body diameter Dn may be directly obtained. As a method of obtaining the bobbin winding body diameter Dn, for example, the bobbin winding body diameter Dn can be obtained through the slit 14 of the cover 13 by using an optical rangefinder.

Fourth Embodiment

In the first embodiment, as the bobbin winding body diameter Dn becomes large, the roller 20 is caused to move in the Y-axis direction, and instead of causing the roller 20 to move, the bobbin 10 and the cover 13 may be caused to move in the Y-axis direction. The roller 20 and both the bobbin 10 and the cover 13 may be caused to move. In this manner, the roller 20, the bobbin 10, and the cover 13 may be caused to move relatively.

Fifth Embodiment

Figure 7:
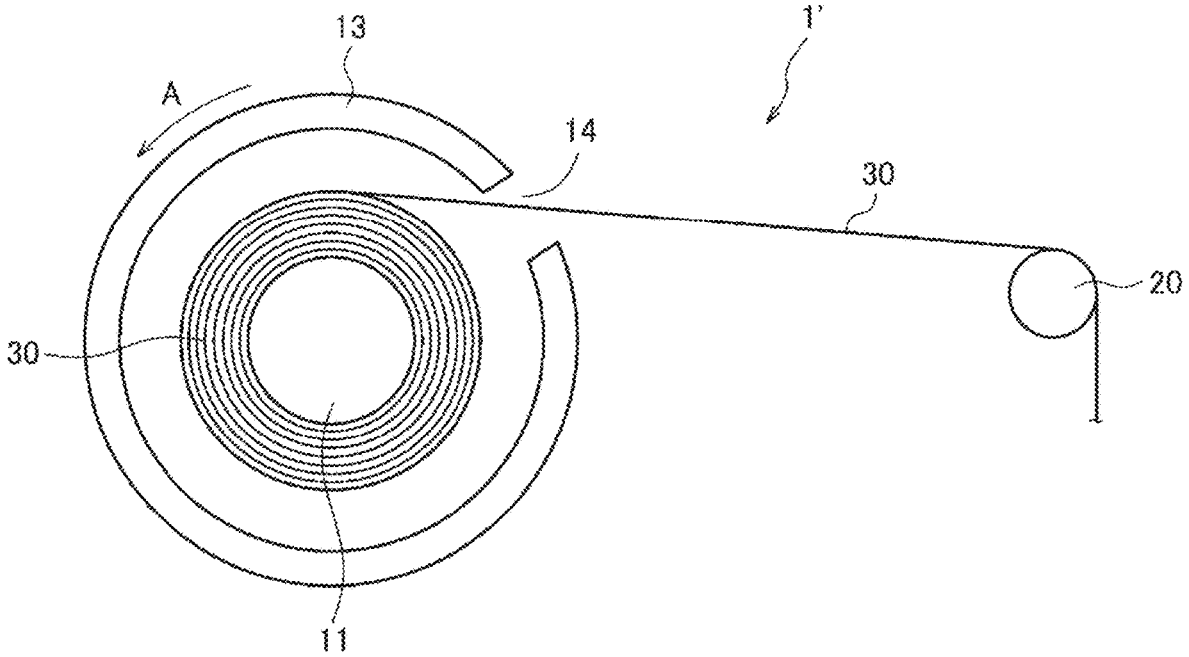
FIG. 7 is a diagram illustrating a configuration example of a winding device according to a fifth embodiment of the present disclosure.

FIG. 7 is a diagram illustrating a configuration example of a winding device according to a fifth embodiment of the present disclosure. In the first embodiment, the roller 20 is caused to move in the Y-axis direction as the bobbin winding body diameter Dn becomes larger, and in a winding device 1' of the fifth embodiment, as the bobbin winding body diameter Dn becomes larger, the location of the slit 14 of the cover 13 is caused to move in a circumferential direction (an arrow A direction) by a drive apparatus not illustrated in the drawing. As a result, it is possible to prevent the cover 13 covering the outer circumference of the bobbin 10 from contacting the optical fiber 30 wound up around the bobbin 10.

Even though any one of methods described in the embodiments is used, the winding device 1 (1') includes the following (a), (b), and (c) inside winding device 1 (1') or as a separate apparatus.

(A) A memory for storing specifications of respective components such as, for example, the diameter r of the optical fiber 30, the diameter R of the body portion of the bobbin 10, the distance Lx in the X-axis direction between the center of the bobbin 10 and the center of the roller 20, the distance La from the contact point S of the bobbin 10 of the optical fiber 30 at the time of the start of winding to the middle point P of the slit 14 of the cover 13, the diameter Lb of the cover 13, or the like.

(B) A memory for storing a program for performing each calculation.

(C) A calculation apparatus for processing the winding-up length of the optical fiber 30 and the bobbin weight or a measurement signal from the optical rangefinder.

REFERENCE SIGNS LIST

1, 1': winding device
10: bobbin
11: body portion
12: flange portion
13: cover
14: slit
20: roller
30: optical fiber

The invention claimed is:

1. A winding device, comprising:

a single bobbin that winds up a filament body;

a cover that covers the bobbin and includes a slit having a longitudinal axis extending parallel to an axial direction of the bobbin such that the filament body is inserted, the cover including an inner space to completely receive the bobbin such that the cover covers an outer circumference of the bobbin;

a roller that guides the filament body directly to the bobbin; and a mechanism for moving the roller relative to the bobbin, depending on a diameter of the filament body wound on the bobbin, so that the filament body does not contact the cover, wherein the mechanism operates to continuously move the roller throughout an actual drawing of the filament body as the diameter of the filament body wound on the bobbin changes, without switching to another bobbin.

2. The winding device according to claim 1, wherein a direction of relative movement between the bobbin and the roller is a direction including a component orthogonal to a direction of the filament body at the start of winding and an axial direction of the roller.

3. The winding device according to claim 1, wherein the bobbin winding body diameter is calculated from a winding-up length of the filament body.

4. The winding device according to claim 1, wherein the bobbin winding body diameter is calculated from a weight of the filament body wound around the bobbin.

5. A winding method for a winding device including a single bobbin that winds up a filament body, a cover that covers the bobbin and includes a slit having a longitudinal axis extending parallel to an axial direction of the bobbin such that the filament body is inserted, and a roller that guides the filament body directly to the bobbin, the cover including an inner space to completely receive the bobbin such that the cover covers an outer circumference of the bobbin, the method comprising:

continuously moving the roller relative to the bobbin throughout an actual drawing of the filament body, depending on a diameter of the filament body wound on the bobbin as the diameter of the filament body changes, so that the filament body does not contact the cover, without switching to another bobbin.

* * * * *